US005438238A

United States Patent [19]

Toy et al.

[11] Patent Number: 5,438,238

[45] Date of Patent: Aug. 1, 1995

[54] MULTIPLE FILAMENT ENHANCED ION SOURCE

[75] Inventors: Stephen W. Toy, Alta; David V. Alexander, Elk Grove, both of Calif.

[73] Assignee: NEC Electronics Inc., Mountain View, Calif.

[21] Appl. No.: 35,337

[22] Filed: Mar. 19, 1993

Related U.S. Application Data

[62] Division of Ser. No. 595,077, Oct. 10, 1990, Pat. No. 5,256,947.

[51] Int. Cl.[6] ..... H01J 7/24

[52] U.S. Cl. ..... 315/94; 315/111.81; 313/231.41

[58] Field of Search ..... 315/94, 105, 111.81, 315/111.21; 313/231.41, 236; 250/423 R, 427

[56] References Cited

U.S. PATENT DOCUMENTS

| | | | |
|---|---|---|---|
| 3,555,342 | 1/1971 | McFall | 313/318 |
| 4,412,153 | 10/1983 | Kalbfus et al. | 315/111.81 |
| 4,447,732 | 5/1984 | Leung et al. | 250/427 |
| 4,527,095 | 7/1985 | Herring | 315/65 |
| 4,541,890 | 9/1985 | Cuomo et al. | 315/111.81 |
| 4,661,710 | 4/1987 | Verney et al. | 250/423 R |
| 4,742,232 | 5/1988 | Biddle et al. | 250/427 |
| 4,766,390 | 8/1988 | Wharton et al. | 315/94 |
| 4,793,961 | 12/1988 | Ehlers et al. | 376/127 |
| 4,841,197 | 6/1989 | Takayama et al. | 315/111.81 |
| 4,886,971 | 12/1989 | Matsumura et al. | 250/4925.2 |
| 4,980,610 | 12/1990 | Varga | 315/111.21 |
| 5,061,879 | 10/1991 | Munoz et al. | 315/65 |
| 5,144,143 | 9/1992 | Raspagliesi et al. | 315/111.81 |

FOREIGN PATENT DOCUMENTS

| | | | |
|---|---|---|---|
| 4327042 | 6/1966 | Japan | 315/94 |

*Primary Examiner*—Robert J. Pascal
*Assistant Examiner*—Michael B. Shingleton
*Attorney, Agent, or Firm*—Skjerven, Morrill, MacPherson, Franklin & Friel

[57] ABSTRACT

An improved ion source is provided with multiple filaments and wiring for selectively connecting various combinations of filaments to a current source. In one embodiment an additional filament is a spare filament which is connected to the current source when the primary filament burns out. This decreases down time due to filament replacement. In another embodiment, an additional filament operates simultaneously with a primary filament to provide a more homogenous electron cloud and to increase filament life.

2 Claims, 6 Drawing Sheets

MULTIPLE FILAMENT ENHANCED ION SOURCE

This is a division of application Ser. No. 07/595,077, filed Oct. 10, 1990, now issued as U.S. Pat. No. 5,256,947.

FIELD OF THE INVENTION

This invention relates to ion implantation equipment, and more specifically to ion sources with improved filament systems to reduce down-time.

Background of the Invention

Ion implantation is commonly used to dope semiconductor material. For example, ion implantation has been used to form source and drain regions, and to adjust the threshold voltages of MOS transistors.

There are several advantages of using ion implantation to dope semiconductors. For example, diffusion requires heating a wafer to high temperatures (in the range of 1000°-1400° C.), whereas ion implantation does not. High temperatures may cause crystal damage but in any event cause the further diffusion of dopants in the wafer thereby changing the sizes of the doped regions. If the transistor uses submicron geometries, such size changes can materially affect the characteristics of the transistor. Further, by using ion implantation a wafer can be doped through a thin oxide layer, and a larger variety of masks can be used than by using diffusion. Ion implantation also generally allows more precise control of doping depth and concentration.

A typical ion implantation machine, shown in FIG. 1, includes an ion source 100 that creates dopant ions to be implanted. Dopant elements used are generally the same as those used in diffusion (for example, As, P, Sb, and B). FIGS. 2*a*, 2*b* and 2*c* show an ion source 100 and an ionization arc chamber 101, in detail. A gas containing dopant atoms is released into chamber 101 which must be kept at a high vacuum level to prevent air molecules from being ionized and implanted into a semiconductor wafer. The dopant gas source contains molecules in which the dopant atom is combined with other atoms. Dopant gas sources generally include those used in diffusion such as flourine-based gases (e.g. $PF_5$, $AsF_5$, $PF_3$). The dopant atoms must be separated from these other atoms in order to provide the ion beam used to bombard the semiconductor wafer.

To separate the dopant atoms out of these molecules, chamber 101 is provided at one end with a filament 102, a wire typically made of tungsten or tantalum. Filament 102 emits electrons when heated by the passage of electric current. The current follows a path through filament 102 as shown in FIGS. 2*a* and 2*b*. When filament 102 is heated to a certain temperature, electrons are "boiled off" filament 102, into chamber 101 in the direction of the arrows, where the dopant gas source is located. The electrons collide with the molecules in the dopant gas source, and separate these molecules into atoms by ionizing them. A repeller plate 103, at the other end of chamber 101, is charged to some positive voltage and accelerates the electrons for more effective collisions and thus a higher ionization rate. A typical repeller plate produces a 3%-5% higher ionization rate.

In addition to the dopant atoms, the ionized dopant gas source contains the other atoms that were combined with the dopant atoms in molecules. The ion beam which will be focussed on the semiconductor wafer must contain only the desired dopant atoms. Thus, a typical ion implantation machine is provided with a mass analyzer 200 for separating the dopant atoms from other atoms. Once separated, the dopant atoms are accelerated by a device such as an acceleration tube 300, and focused by a device such as magnetic lens 400, into an ion beam. This ion beam is directed in a controlled fashion by devices such as beam traps, beam gates and scanners 500, onto semiconductor wafers 600.

The electron cloud produced by filament 102 is not homogenous within chamber 101, despite the force provided by repeller plate 103. As the distance from filament 102 increases, the density of the electrons decreases producing an electron depletion zone in a region R which is the most distant region of chamber 101 from filament 102. If the density were homogenous, and there were no depletion zone, both the number and the effectiveness of collisions between electrons and dopant gas source molecules would increase thus enhancing the performance of the ion source.

Due to the large currents that flow through filament 102, filament 102 must be regularly replaced. Filament replacement is responsible for a large percentage of down-time of an ion implantation machine. Replacing a filament is an involved multi-step process requiring careful execution. First the pressure in the source chamber must be vented from high vacuum to atmosphere. Next, the ion source must be removed and the filament replaced. Then the ion source must be re-installed and the system pumped back to high vacuum. This entire process typically takes from 2-3 hours. If a machine is otherwise running efficiently, the filament will typically require replacement from 10-30 times per month, which accounts for 40-50% of all downtime. It would be desirable to decrease the amount of downtime due to filament replacement.

SUMMARY OF THE INVENTION

The present invention provides an ion source with at least one spare filament. In one embodiment, the spare filament is provided across from a primary filament, where a repeller plate is typically located. In this embodiment the spare filament is not in operation while the primary filament is in operation. Wiring is provided to allow selectively routing current to pass through either the primary filament or the spare filament. The filament not in operation is provided with a bias voltage so as to function as a repeller plate. To remove the primary filament from, and connect the spare filament to, the current source, only a current carrying lead need be moved from a filament post connected to the primary filament to a filament post connected to the secondary filament. This enables easily installing the spare filament into the ion source when the primary filament either burns out or has degraded performance without having to execute the time-consuming steps involved in replacing a filament. Downtime is thus significantly decreased. In a second embodiment, an additional filament is provided at an opposing end of the arc chamber from the primary filament and will operate simultaneously with the primary filament. The electron cloud density produced by the dual filament ion source is substantially homogenous and lacks the depletion zone found in a single filament system. Thus the ionization rate is significantly increased. Further, since the effective length of the filament and thus the resistance of the filament is increased by 150%-200%, current flowing through the filament is decreased so that filament life is increased.

The increased effective length of the filament also results in a decrease in usage demand per unit length of the filament since each filament will only have to emit a portion of the electrons it would have to emit were it the only active filament. This decrease in usage demand further increases filament life.

FIG. *2a* is a cross-sectional schematic diagram of a section of typical ionization arc chamber.

FIGS. *2b* and *2c* are an end view and a cross-sectional schematic diagram, respectively, of a typical ion source.

FIGS. *3a*, *3b* and *3c* are a cross-sectional schematic view, a side view, and an end view, respectively, of an ionization arc chamber provided with a spare filament in accordance with this invention.

Figure 1:
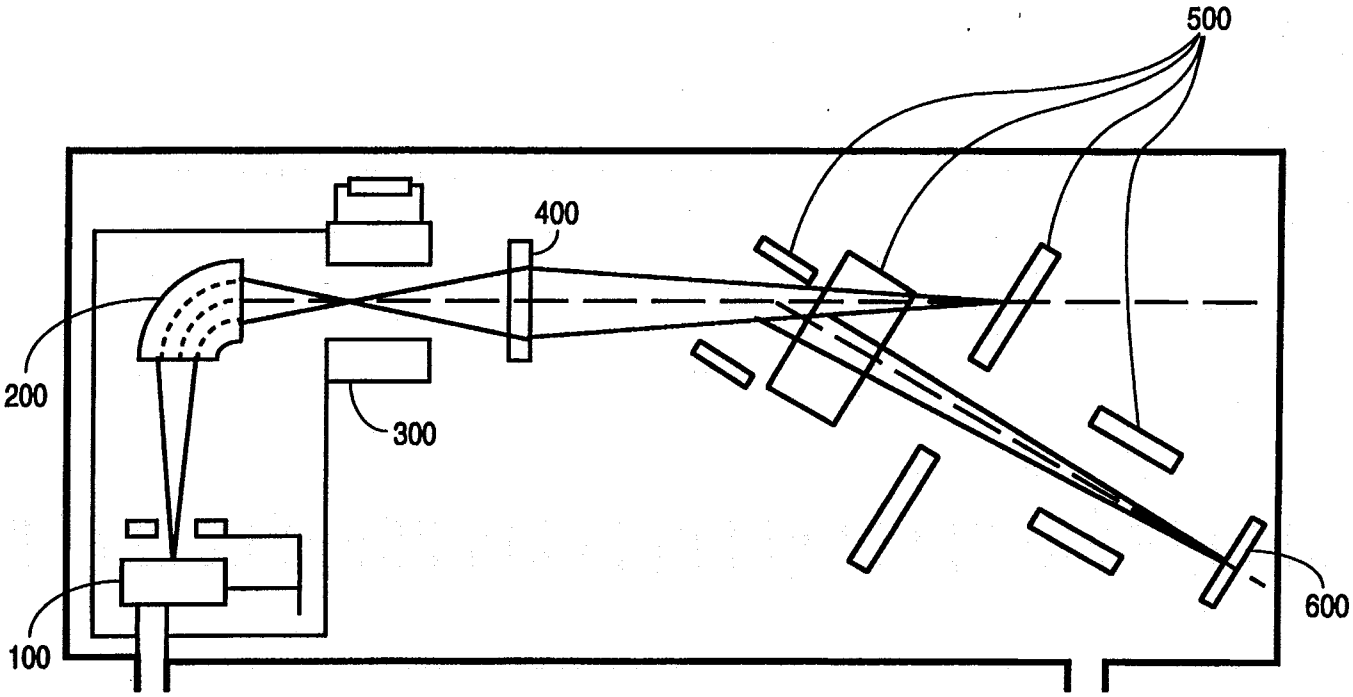
Fig. 1 Prior Art
FIG. 1 is a block diagram of a typical ion implantation machine.
Figure 2A:
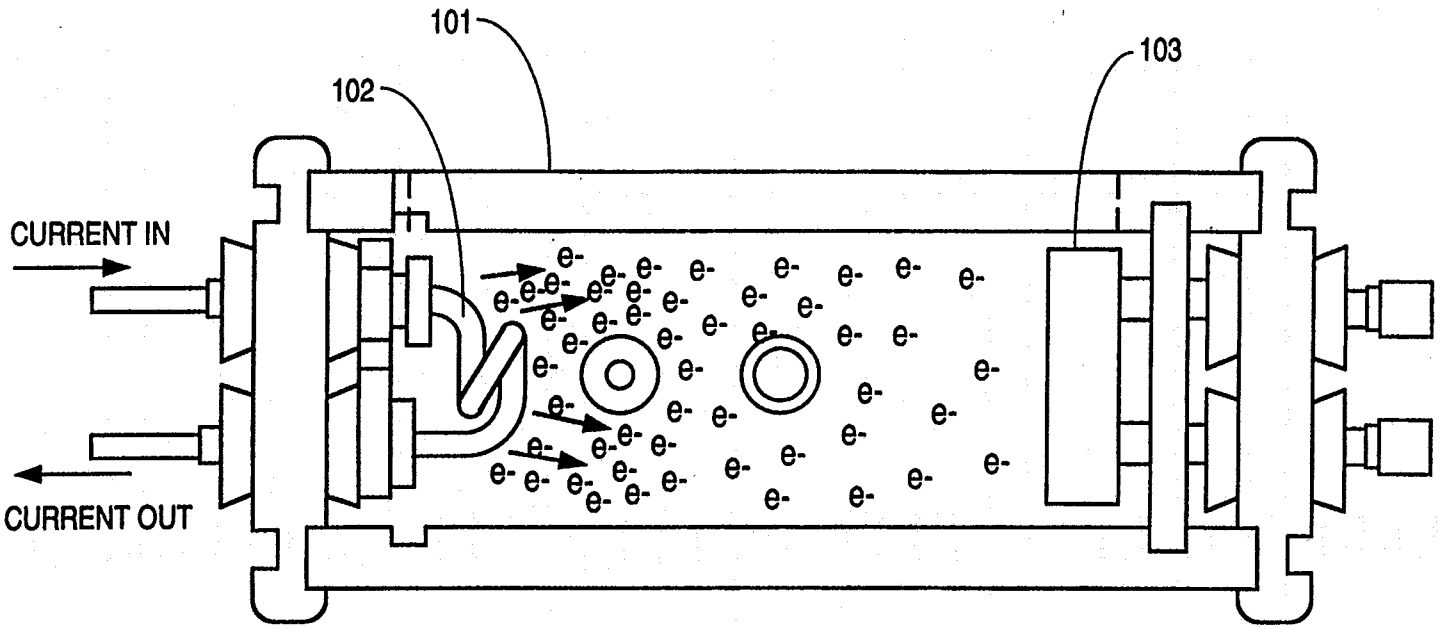
Fig. 2a Prior Art
Figure 2C:
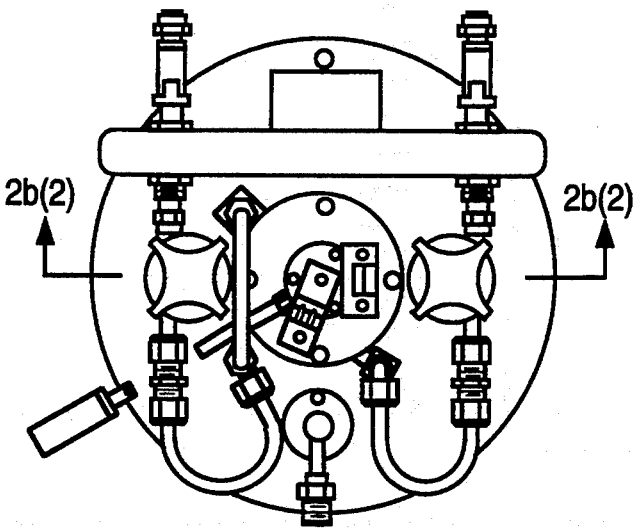
Fig. 2c Prior Art
Figure 2B:
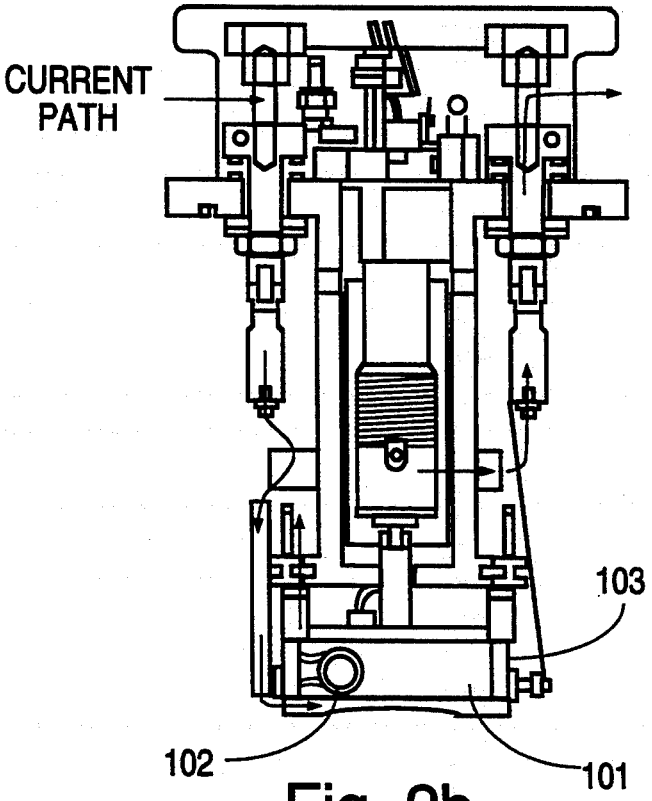
Fig. 2b Prior Art
Figure 3A:
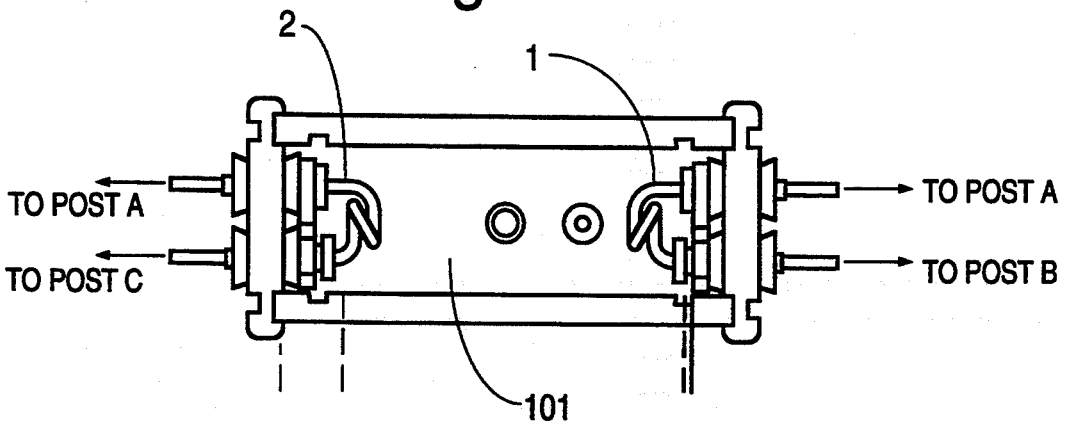
Figure 3B:
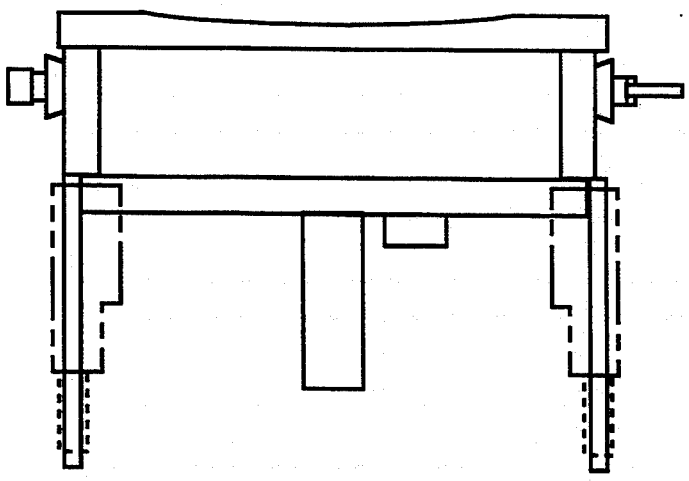
Figure 3C:
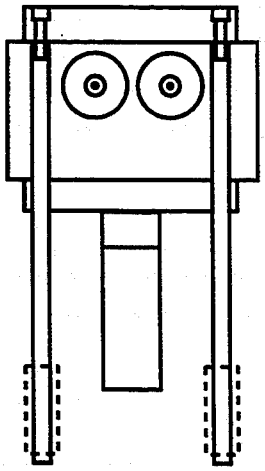
Figure 4:
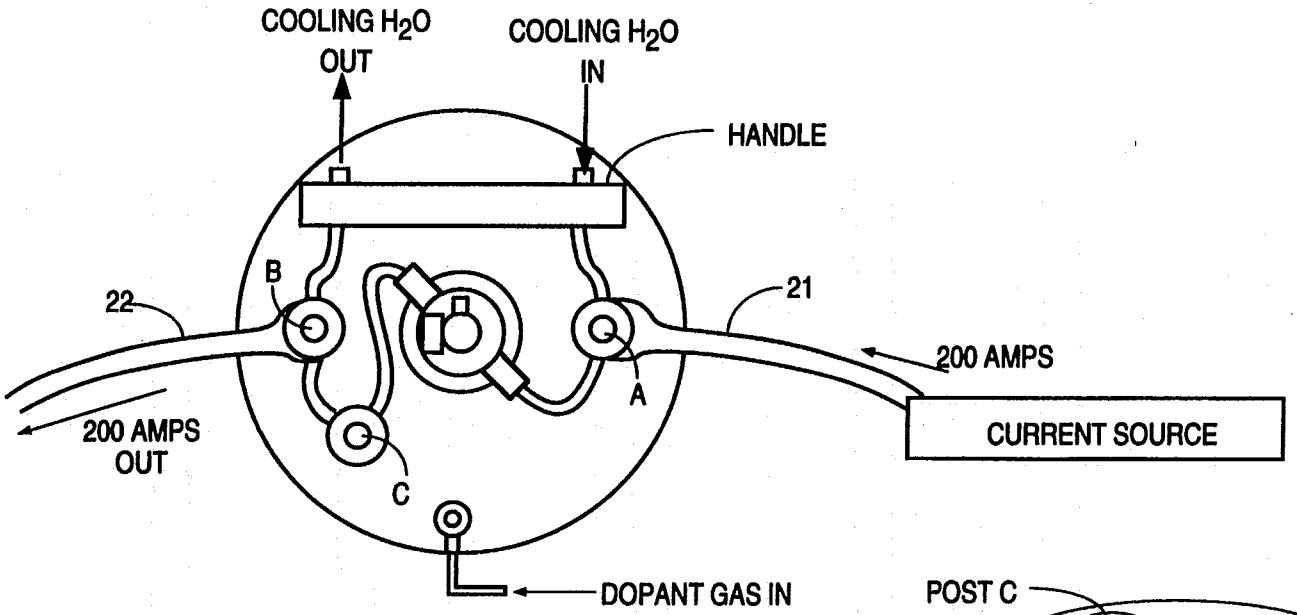

FIG. 4 is a top view of a vaporizer assembly containing an ion source provided with a spare filament and an additional filament post in accordance with this invention.

Figure 5:
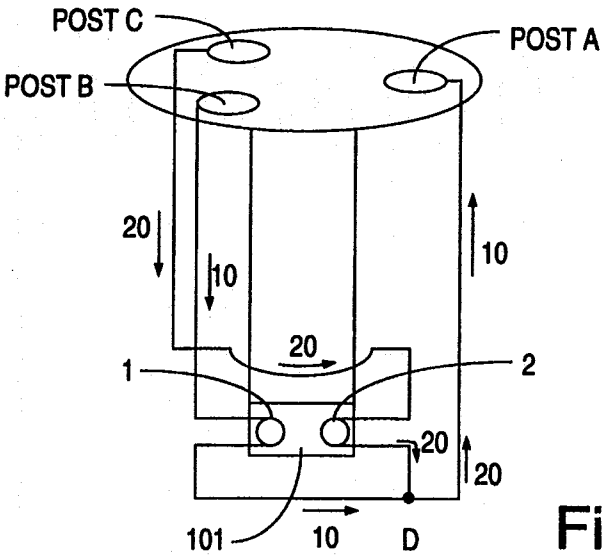

FIG. 5 is a side cross-sectional schematic diagram of the vaporizer assembly of FIG. 4.

Figure 6:
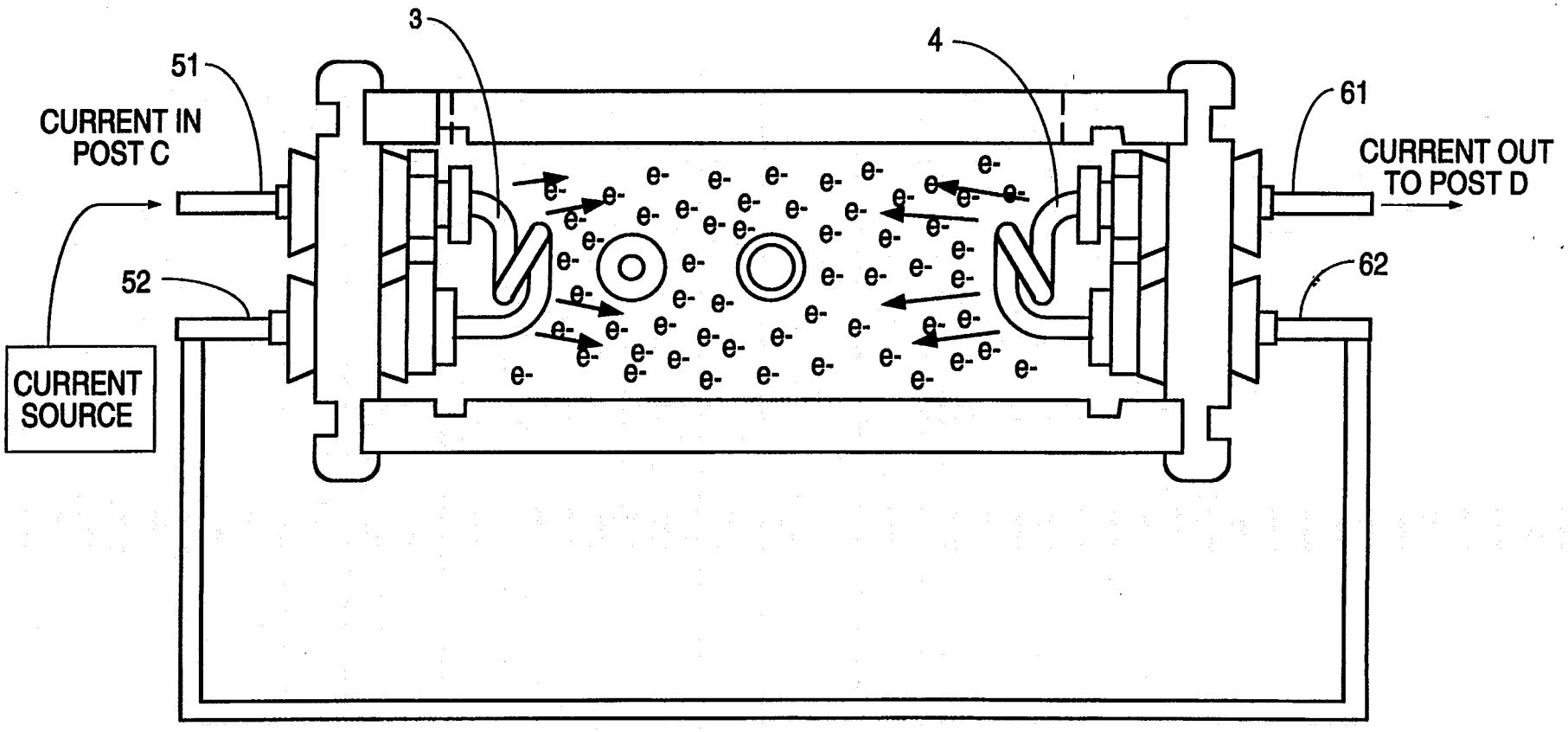

FIG. 6 is a cross sectional schematic diagram of an ionization arc chamber provided with an additional filament that will operate simultaneously with the primary filament in accordance with this invention.

DETAILED DESCRIPTION

In one embodiment of this invention, shown in FIG. *3a*, an additional filament 2 is provided at an opposing end of chamber 101 from the primary filament 1, where a repeller plate is typically located. In,this embodiment, additional filament 2 is a spare filament, provided to be used when either the performance of primary filament 1 degrades, or primary filament 1 burns out. Typically, a filament has two terminals, and a post corresponding to each terminal. One terminal, and a corresponding post, is for current to flow in and a second terminal, and a corresponding post, is for the current to flow out. In this embodiment, there are only three posts for two filaments (and four filament terminals) as shown in FIGS. 4 and 5. One filament post A is common to both the primary and the spare filament. Post B is connected only to the primary filament, and post C is connected only to the spare filament.

While primary filament 1 is adequately working, filament lead 21 is connected to filament post A, and filament lead 22 is connected to filament post B. In this configuration, the current follows path 10 shown in FIG. 5 from post B, through filament 1, and continuing on path 10 to post A. When either the performance of primary filament 1 sufficiently decreases, or primary filament 1 burns out, filament lead 22 can be removed from post B and connected to post C to install spare filament 2. In this configuration, the current follows path 20 shown in FIG. 5 from post C through filament 2 to node D, and continuing on path 20 to post A. Switching a filament lead from one filament post to another takes one to two minutes, in contrast to two-three hours to replace the filament in the prior art, and thus significantly reduces the down-time of the ionization implanting machine.

More than two filaments can be included in the arc chamber by iterating the structure provided above. One terminal of each additional filament is connected to the common post, and for each additional filament, a post will be provided for the other terminal. One current carrying filament lead 21 is connected to the common post. Thus, to connect any filament to the current source, the filament lead 22 is connected to the non-common post of that filament.

In a second embodiment, as shown in FIG. 6, an additional filament 4 carries current simultaneously with, and in the same path as, the primary filament 3. In this embodiment only two filament posts, C and D, are needed. Post C is connected to terminal 51 of filament 3, and post D is connected to terminal 61 of filament 4. Terminal 52 of filament 3 is connected to terminal 62 of filament 4, so that current can flow into terminal 51 of filament 3, through filament 3 to terminal 52, and then to terminal 62 of filament 4, through filament 4, and finally out through terminal 61 of filament 4. Additional filament 4 boils off electrons in a region R of the arc chamber away from the primary filament 3. In a single filament system, this region R had a depleted electron density because the electron cloud produced by a single filament decreased in density as the distance from the filament increased. By providing additional filament 4 at an opposing end of chamber 101, the most distant region of chamber 101 from primary filament 3, the present invention provides that the region R will not have a depleted electron density. This homogenous electron cloud density increases the number and effectiveness of collisions, and thus the performance of the ion source 100.

The above description is meant to be illustrative only, and not limiting. For example, in accordance with the present invention more than two filaments could be provided in order to further increase the electron cloud density. Further, additional filaments may be located in other areas of the arc chamber in order to achieve some particular configuration of electron cloud density.

We claim:

1. An ion source powered by a current source comprising:

an elongated arc chamber having first and second opposing longitudinal ends; and a plurality of electron-generating filaments mounted in said chamber, a first one of said plurality of electron-generating filaments being mounted at said first longitudinal end and a second one of said plurality of electron-generating filaments being mounted at said second longitudinal end; and means for coupling at least said first and second ones of said plurality of electron-generating filaments in series to said current source such that ions generated by said first and second ones of said plurality of electron-generating filaments form an electron cloud within said arc chamber.

2. An ion source powered by a current source comprising:

an elongated arc chamber having first and second opposing longitudinal ends; and a first electron-generating filament mounted at said first longitudinal end and a second electron-generating filament mounted at said second longitudinal end, both said first and second electron-generating filaments being mounted in said arc chamber, wherein said first electron-generating filament and said second electron-generating filament are connected to said current source simultaneously and in series; and wherein ions generated by said first and second electron-generating filaments form an electron cloud within said arc chamber.

* * * * *